US005837972A

United States Patent [19]

Padilla

[11] Patent Number: 5,837,972

[45] Date of Patent: Nov. 17, 1998

[54] HAIR CURLING IRON WITH LENGTH AND DIAMETER ADAPTATION

[76] Inventor: Richard P. Padilla, 3501 Ruth Pl., Orange, Calif. 92669

[21] Appl. No.: 627,318

[22] Filed: Apr. 1, 1996

[51] Int. Cl.[6] ..... A45D 1/04

[52] U.S. Cl. ..... 219/225; 219/227; 219/537; 219/541; 338/295; 132/232

[58] Field of Search ..... 219/225, 222, 219/221, 227–230, 231, 243, 541, 533, 537, 536, 539; 338/203, 295; 132/224, 225, 232, 229, 230, 231, 269; 606/27–31; 228/51

[56] References Cited

U.S. PATENT DOCUMENTS

| | | | |
|---|---|---|---|
| 1,743,577 | 1/1930 | Smith | 219/537 |
| 1,869,599 | 8/1932 | Lewis | 219/226 |
| 1,894,751 | 1/1933 | Baum | 219/225 |
| 2,544,326 | 3/1951 | Jones | 219/227 |
| 2,859,325 | 11/1958 | Lea | 219/228 |
| 3,622,746 | 11/1971 | Trouihet | 219/225 |
| 3,805,811 | 4/1974 | Dorn | 219/222 |
| 3,859,497 | 1/1975 | McNair | 219/225 |
| 3,955,064 | 5/1976 | Demetrio et al. | 219/225 |
| 4,533,819 | 8/1985 | Valiulis | 219/225 |
| 4,581,519 | 4/1986 | Thaler et al. | 219/225 |
| 4,851,641 | 7/1989 | Barowski et al. | 219/225 |
| 4,976,173 | 12/1990 | Yang | 81/54 |

FOREIGN PATENT DOCUMENTS

| | | | |
|---|---|---|---|
| 1116118 | 10/1961 | Germany | 219/229 |
| 249805 | 9/1987 | Germany . | |
| 53-143045 | 12/1978 | Japan | 219/537 |

*Primary Examiner*—John A. Jeffery
*Attorney, Agent, or Firm*—Gene Scott-Patent Law & Venture Group

[57] ABSTRACT

A hair curling device is made up of one or more heating units which may be plugged into a handle and into each other to make up a heating surface of a selected length. A set of electrodes in the heating units are configured so that a voltage provided by the handle is impressed across a heating resistance within the heating units. Each additional heating unit, when plugged into the handle or a previously installed heating unit, changes the electrode configuration so that the heating current is routed into each new heating unit. A current limiting device is provided so that the temperature of the device is selectable. Heating units of various diameter are provided so that loose or tight curling is made possible by the simple expedient of snapping a different set of heating units into the handle.

7 Claims, 3 Drawing Sheets

HAIR CURLING IRON WITH LENGTH AND DIAMETER ADAPTATION

BACKGROUND OF THE INVENTION

1. Field of the Invention

This invention relates generally to curling irons, and more particularly to an improved curling iron having interchangeable parts for lengthening and for various diameters.

2. Description of Related Art

Invention and use of curling irons is well known to the public, as they are frequently used in both commercial establishments and at home. Barowski, et al., U.S. Pat. No. 4,851,641 discloses an electrically heatable curling iron comprising an elongated curling structure including an electrical heating unit, a handle adapted to be connected to an electrical supply and having disengageable mechanical and electrical connecting means provided between the curling structure and the handle. Mc Nair, et al., U.S. Pat. No. 3,859,497 discloses a handle and clamp structure for a hair curling instrument of the type having a hair heating element projecting from the end of the handle and a clamp pivotally fulcrumed on the handle, the clamp having a clamping portion adapted to clamp hair to the heating element along the major portion thereof Dom, et al., U.S. Pat. No. 3,805,811 discloses an apparatus for styling hair comprised of a hollow handle containing a water supply, a heating element disposed in a tubular jacket extending outwardly from the handle, a two armed spring biased lever having a longer arm conforming to the configuration of the jacket and adapted to clamp hair being treated between it and the jacket, and a water supply container in the handle. At least a portion of the container holding the water is deformable to supply water to the jacket where it is heated and then exists through apertures in the jacket to moisten the hair. Trouihet, et al., U.S. Pat. No. 3,622,746 discloses electrical tongs which comprise a thermostat which is manually adjustable by a knob embedded in a recess provided in the tongs handle. The handle recess includes indentations adapted to mesh with corresponding indentations provided at the periphery of a ring interposed between the knob and the recess for presetting the temperature range of the tongs. The ring includes internal stops and the knob also comprises stop means so that, upon rotating the knob within the ring, the rotary motion of the knob controlling the heating temperature is limited. Thaler et al., U.S. Pat. No. 4,581,519 discloses a hair curling iron which comprises a heat conductive cylinder having an exterior surface and a hollow center, the exterior surface being flocked; a handle joined to said cylinder; a heating element disposed within said hollow center of the cylinder; electrical means capable of electrically activating the heating element when coupled to a source of electrical power, and a clamping means having a partial cylindrical section having inner and outer surfaces with the inner surface being positioned to be urged against the flocked outer surface.

However, the prior art does not teach a curling iron that is adaptable for length and diameter change. The present invention fulfills these needs and provides further related advantages as described in the following summary.

SUMMARY OF THE INVENTION

The present invention is an improved hair curling iron. A handle provides a base into which various heating units may be plugged. These heating units may be of various diameters and length. In a preferred embodiment one heating unit is plugged into the handle and another is plugged into the first, and so on, until a desired length is achieved. Each of the heating units is adapted to mechanically engage the next and to also electrically cascade the next heating unit to the previous one. Thus, it is an object of the present invention to provide an improved curling iron having adaptability for length of hair, as well as for producing loose curls and tighter curls. It is a further, and more specific object of the present invention to teach a curling iron capable of being quickly disassembled and stored in a compact manner. It is a further object to teach a curling iron that is easily and quickly assembled from elements capable of producing a length and diameter to meet the needs of a wide variety of applications. It is a final object of the invention to teach a curling iron having interchangeable heating units, where each unit, when inserted into the previous one, is not only mechanically interlocked in place, but also where the insertion mechanics change the electrode configuration so that the electrical circuit is extended to include the newly inserted unit.

Other features and advantage s of the present invention will become apparent from the following more detailed description, taken in conjunction with the accompanying drawings, which illustrate, by way of example, the principles of the invention.

BRIEF DESCRIPTION OF THE DRAWING

The accompanying drawings illustrate the present invention, a curling iron. In such drawings.

DETAILED DESCRIPTION OF THE PREFERRED EMBODIMENT

Figure 7:
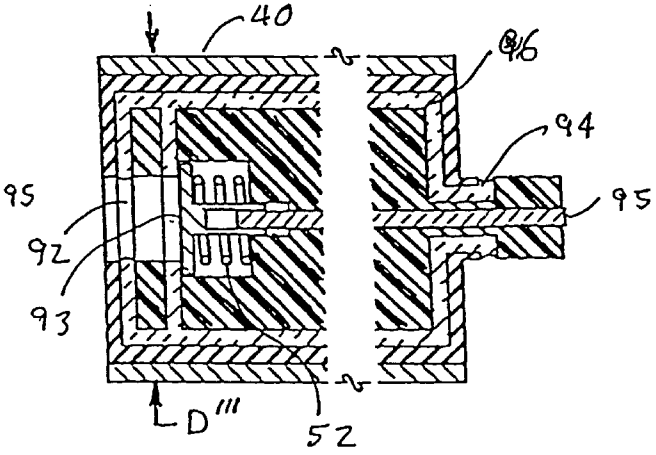
FIGS. 5–7 are cross-sectional views in accordance with those of FIGS. 3 and 4 illustrating the possible various diameters that might be substituted in the invention.
Figure 8:
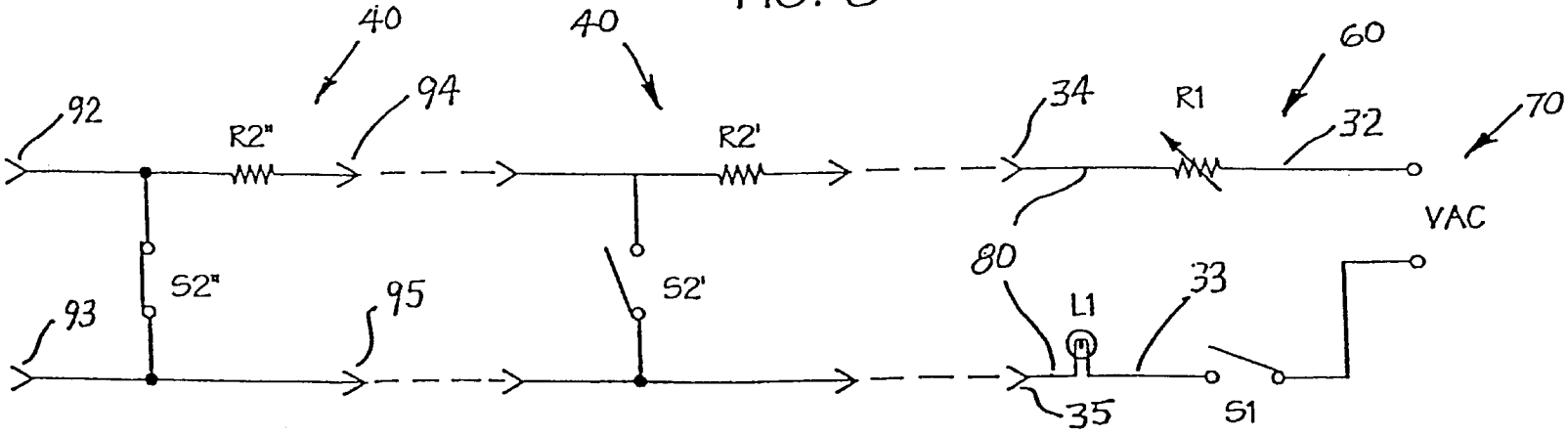
FIG. 8 is an electrical schematic diagram of the invention.

The above described drawing figures, FIG. 1–8, illustrate a component oriented, portable curling iron, adaptable in length and in diameter of the heating unit. The curling iron has an elongated handle 10 providing a gripping surface 20 so that the curling iron may be handled during the process of curling the hair. The handle provides a handle socket means 30 for receiving a cylindrical heating unit 40. Additional heating units 40 are plug compatible with each other, so that the heated portion of the curling iron may be extended to any length desired. An outer surface 50 of the heating units 40 is electrically heated to an appropriate temperature for curling hair. An electrical circuit 60 housed within the handle 10 includes a power cord 70 for engagement with an AC power outlet (not shown), thus providing an electrical voltage to the handle 10. The circuit 60 also includes a power switch S1 for making and defeating the circuit 60, and a current limiting means R1 such as a variable electrical resistance, for adjusting the level of current flow in the heating units 40, and a means for interconnecting the voltage 80 from the power cord 70 to the handle socket means 30. Additionally the circuit may include a lamp L1, visible on the handle 10, so as to provide a means for knowing if the curling iron is drawing current. The circuit is interconnected as shown in FIG. 8, so that the lamp L1 is only lighted when a current is flowing in one or more of the heating units 40. A plurality of the cylindrical heating units 40 are provided. Each of the heating units includes a heater socket means 90 within one end of the heating unit 40 and a plug means 100 adapted for press-in engagement within the handle socket means 30 or the heater socket means 90 of any one of the other heating units 40. The plug means 100 on each of the heater units 40 extends outwardly from the opposing, other end of the heating unit 40 thereby providing a means for electrical connection with the handle socket means 30 or the heater socket means 90 of any one of the other heating units. In this way, the electrical voltage at the handle 10 is impressed across each of the heating units 40 that are cascaded from the handle 10, all of the heating resistances, R2', R2" . . . of the heating units 40 being placed in electrical series interconnection. Alternatively, the resistances, R2', R2" . . . may be placed in electrical parallel interconnection. A hair clamp 110 for holding a lock of hair (not shown) against the outer surface 50 of one of the heating units 40 may be included, and is preferably mounted on the particular heating unit 40 that is engaged with the handle 10. Such a hair clamp 110 may be of any one of several common varieties well known in the prior art. A hand grip 120 providing a dummy plug 130 extending outwardly from it, is used at the socket end of the last heating unit 40 in order to provide a means for holding the free end of the invention when it is hot. The dummy plug 130 is of a shape and size for press-in engagement within the heater socket means 90 of any one of the heating units 40, and is made of a thermally insulating material so that with the hand grip 120 engaged with a hot heating unit 40, an outer surface 140 of the hand grip 120 remains comfortable to the touch.

Figure 1:
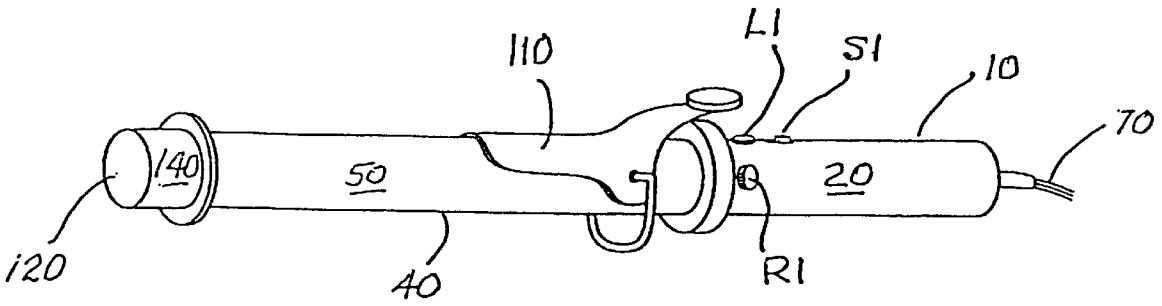
FIG. 1 is a perspective view of the preferred embodiment of the present invention showing a single heating unit of the invention.
Figure 2:
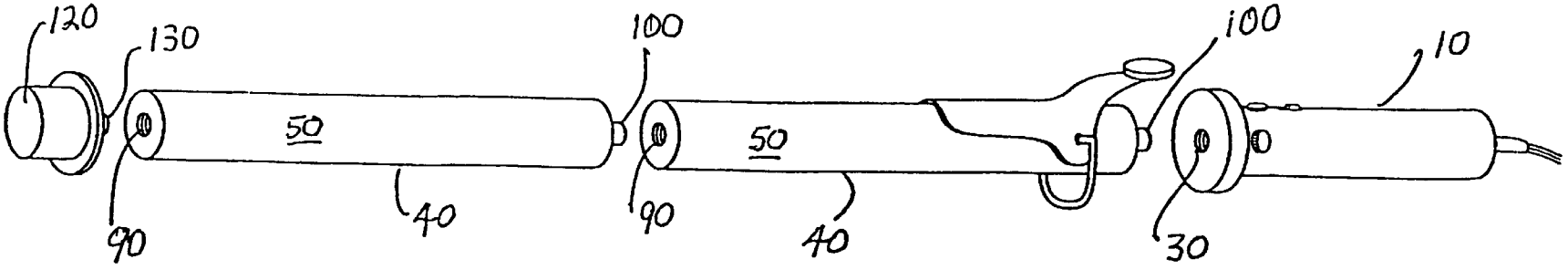
FIG. 2 i s a perspective exploded view thereof, showing how the various elements of the invention may be plugged together in general, and illustrating the use of two heating units of the invention.
Figure 3:
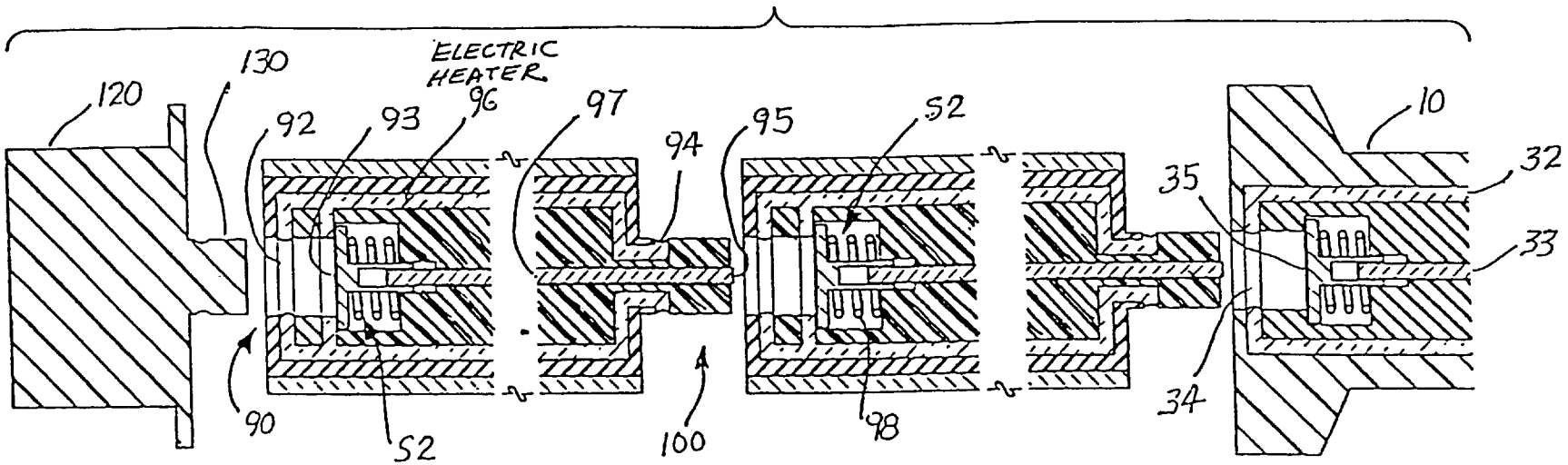
FIG. 3 is a cross-sectional view taken along the longitudinal center line in FIG. 2.
Figure 4:
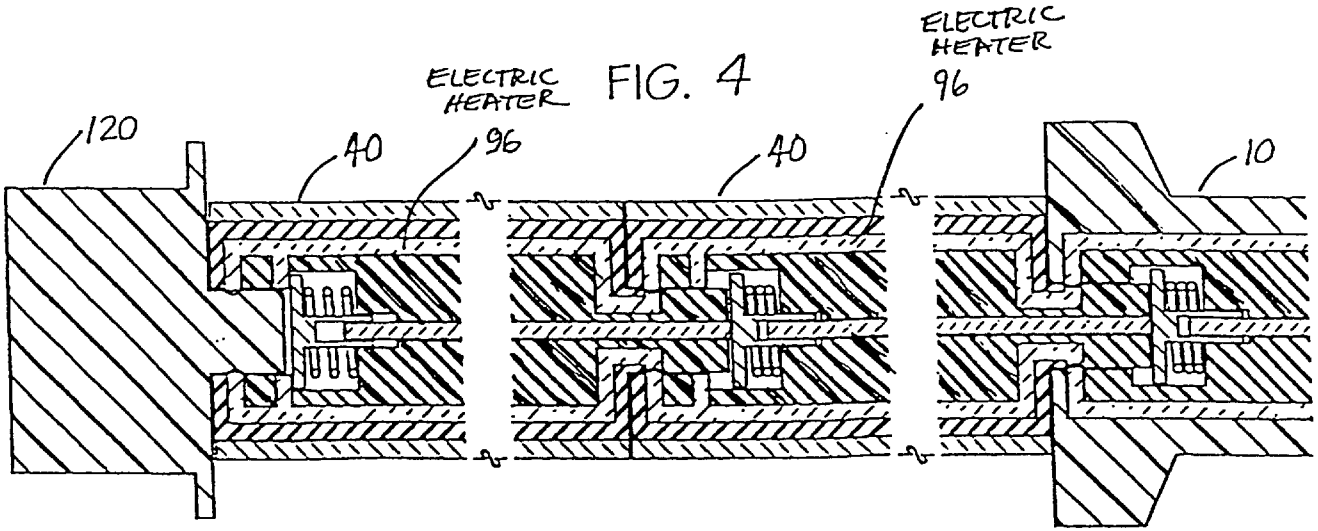
FIG. 4 is a cross-sectional view as in FIG. 3, but showing the various elements of the invention mutually interengaged.

As shown in FIG. 3, the heater socket means 90 of the heating units 40 provides an annular, heater socket electrode 92, and the plug means 100, provides an annular, heater plug electrode 94, these annular electrodes 92, 94 being interconnected by an electrical heating resistance 96. The heating units 40 further providing a central, heater socket electrode 93, and a central, heater plug electrode 95, the central electrodes 93, 95 being interconnected by a heater unit electrical conductor 97. The central, heater socket electrode 93 is movable on the heater unit electrical conductor 97 and is preferably biased so as to normally lie in electrical contact with the annular heater socket electrode 92. The central, heater socket electrode configuration functions as switch S2 in FIG. 8. Note that S2 is normally closed due to a bias means 98, shown as a coil spring in FIGS. 3–7. Therefore, current may flow in the electrical heating resistance 96 for heating the outer surface 50 of the heating unit 40. The plug means 100 of one of the heating units 40 engages the socket means 90 of any other of the heating units 40, the central, heater socket electrode 93 of the other of the heating units being thereby forced away from contact with the annular, heater socket electrode 92 so that the voltage is impressed across the plug electrodes 94, 95 of the one of the heating units 40. The plug means 100 and both of the socket means 30 and 90 are mechanically adapted for interlocking when the plug means 100 is inserted into either of the socket means 30, or 90. This is preferably accomplished, as shown in FIGS. 3 and 4 by providing conforming surfaces on the electrodes 92 and 94, one being convex, the other being concave, so that when mated, these electrodes not only make electrical interconnection, but provide mutual mechanical interlocking as well.

The means for providing the voltage 80 to the handle socket means 30 is a pair of handle conductors 32, 33 in coaxial juxtaposition. The conductors 32, 33 interconnect the power cord with an annular handle socket electrode 34 and a central, handle socket electrode 35 respectively. The handle electrodes 34, 35 are positioned to accept the heating unit plug electrodes 94, 95 respectively, of any one of the heating units 40, thereby providing the voltage impressed across the handle electrodes 34, 35 onto the plug electrodes 94, 95.

Figure 6:
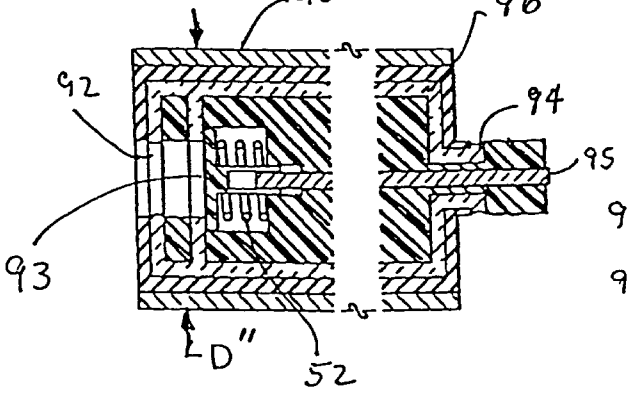
Figure 5:
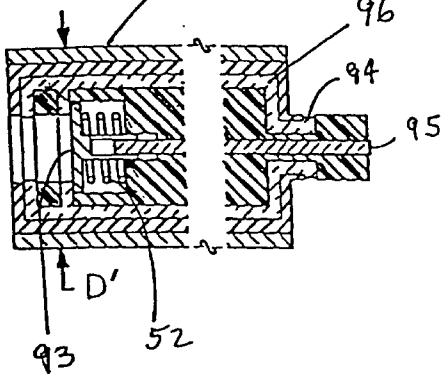

As shown in FIGS. 5–7 the heating units may be made up of several of the heating units where each has a first outside diameter D', and several other of the heating units having at least one other outside diameter D". Preferably, three different outside diameters D', D", and D"' are provided to enable curling loosely or tightly as desired. All of the heater units are plug compatible with the handle socket means and with each other, so that varying length curling irons may be built up.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. A curling iron apparatus comprising:

a handle providing a gripping surface, a handle socket means for receiving a cylindrical heating unit, and an electrical circuit including a power cord providing an electrical voltage to the handle, a power switch for making and defeating the circuit, a current limiting means, and a means for providing the voltage to the handle socket means from the power cord;

a plurality of cylindrical heating units, each of the heating units including a heater socket means within one end of the heating unit and a plug means adapted for press-in engagement within the handle socket means of the handle or the heater socket means of any one of the other heating units of the plurality of heating units, the plug means extending outwardly from the other end of the heating unit and providing means for mechanical interlocking and electrical interconnection with the handle socket means of the handle or the heater socket means of any one of the other heating units of the plurality of heating units that are electrically interconnected with the handle, for receiving the voltage therefrom.

2. The apparatus of claim 1 wherein the electrical circuit of the handle includes a lamp mounted so as to be visible on the handle, the lamp interconnected so to be illuminated only when a current is flowing in at least one of the heating units.

3. The apparatus of claim 1 further including a hair clamp for holding a lock of hair against one of the heating units.

4. The apparatus of claim 1 further including a hand grip providing a dummy plug extending outwardly therefrom, the dummy plug of a shape and size for press-in engagement and mechanical interlocking within the heater socket means of any one of the heating units, the hand grip made of a thermally insulating material so that with the hand grip engaged with a hot surface of one of the heating units, an outer surface of the hand grip remains comfortable to the touch.

5. The apparatus of claim 1 wherein each of the heating units provides an annular heater socket electrode, and an annular heater plug electrode, the annular electrodes being interconnected by an electrical heating resistance, the heating units furter providing a central, heater socket electrode, and a central, heater plug electrode, the central electrodes being interconnected by a heater unit electrical conductor, the central, heater socket electrode being movable on the heater unit electrical conductor so as to normally lie in electrical contact with the annular heater socket electrode so that a current may flow in the electrical heating resistance for heating an outer surface of the heating unit, the plug means of one of the heating units engaging the socket means of any other of the heating units, the central, heater socket electrode of the other of the heating units being thereby moved away from contact with the annular heater socket electrode so that the voltage is impressed across the plug electrodes of the one of the heating units.

6. The apparatus of claim 5 wherein the means for providing the voltage to the handle socket means is a pair of handle conductors in coaxial juxtaposition, the conductors interconnecting the power cord with an annular handle socket electrode and a central, handle socket electrode respectively, the handle electrodes being positioned to accept the heating unit plug electrodes respectively, of any one of the heating units thereby providing the voltage impressed across the handle electrodes onto the plug electrodes.

7. The apparatus of claim 1 wherein the heating units are made up of several of the heating units having a first outside diameter, and several other the outside diameter different from of the heating units having at least one other outside diameter different from said first outside diameter.

* * * * *